United States Patent [19]

Innocenti

[11] Patent Number: 4,859,417

[45] Date of Patent: Aug. 22, 1989

[54] COPPER-BASED METAL ALLOY OF IMPROVED TYPE, PARTICULARLY FOR THE CONSTRUCTION OF ELECTRONIC COMPONENTS

[75] Inventor: Stefano Innocenti, Gallicano, Italy

[73] Assignee: Europa Metalli-Lmi Societa Per Azioni, Firenzi, Italy

[21] Appl. No.: 279,297

[22] Filed: Nov. 30, 1988

Related U.S. Application Data

[63] Continuation of Ser. No. 95,060, Sep. 9, 1987, abandoned.

[30] Foreign Application Priority Data

Sep. 11, 1986 [IT] Italy ..... 48445 A/86

[51] Int. Cl.[4] ..... C22C 9/02; C22C 9/00

[52] U.S. Cl. ..... 420/493; 420/469; 420/492; 420/494; 420/495

[58] Field of Search ..... 420/489, 492–495

[56] References Cited

U.S. PATENT DOCUMENTS

| | | | |
|---|---|---|---|
| 3,677,745 | 7/1972 | Finley et al. | 420/494 |
| 4,202,688 | 5/1980 | Crane et al. | 148/12.7 C |
| 4,233,067 | 11/1980 | Sawada | 420/494 |
| 4,305,762 | 12/1981 | Caron et al. | 148/12.7 C |
| 4,337,785 | 7/1982 | Sato et al. | 420/494 |
| 4,400,351 | 8/1983 | Komori et al. | 420/494 |
| 4,666,667 | 5/1987 | Kamio et al. | 420/494 |

FOREIGN PATENT DOCUMENTS

| | | | |
|---|---|---|---|
| 0175183 | 3/1986 | European Pat. Off. . | |
| 2032972 | 11/1970 | France . | |
| 2089440 | 1/1972 | France . | |
| 0114338 | 8/1984 | Japan | 420/492 |
| 0046340 | 3/1985 | Japan | 420/492 |

OTHER PUBLICATIONS

Thury Metall, 11 (1961) 1079.

*Primary Examiner*—Upendra Roy
*Attorney, Agent, or Firm*—Michael N. Meller

[57] ABSTRACT

A new copper-based alloy is described, the principle characteristic of which lies in having two different age-hardening temperature intervals corresponding to which significantly different electrical and mechanical characteristics are obtained from an alloy of the same composition; the alloy is composed, in parts by weight, of from 0.05 to 1% Mg, from 0.03 to 0.9% P and from 0.002 to 0.04% Ca, the remainder being Cu with possible very small additions of other alloying elements such as Sn, Zr, Mn and Li.

8 Claims, 1 Drawing Sheet

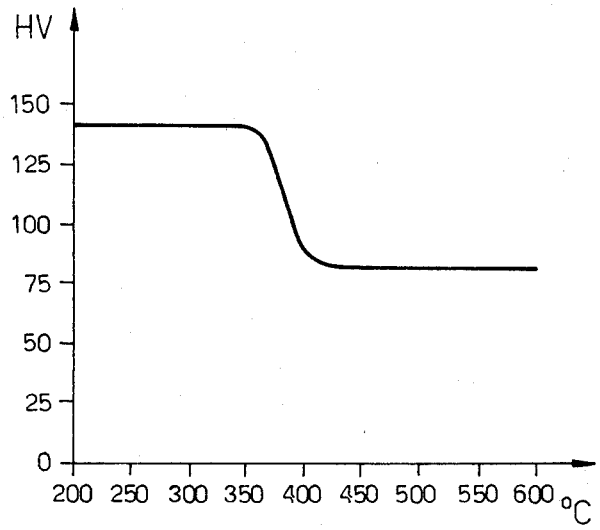
Fig.1
Fig.2
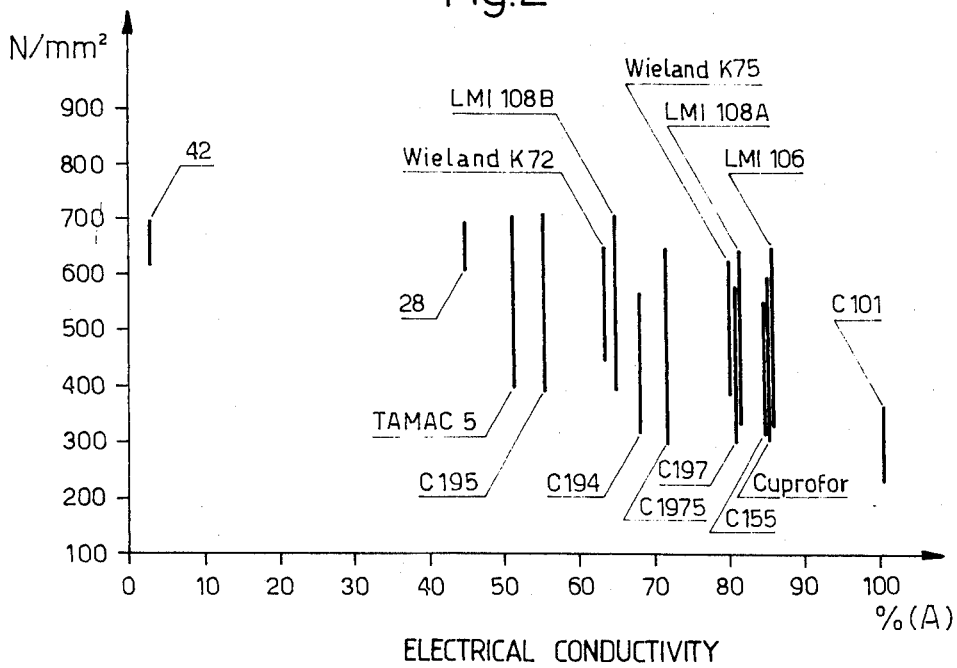

COPPER-BASED METAL ALLOY OF IMPROVED TYPE, PARTICULARLY FOR THE CONSTRUCTION OF ELECTRONIC COMPONENTS

This application is a continuation of application Ser. No. 095,060, filed 9/9/87, now abandoned.

BACKGROUND OF THE INVENTION

The present invention relates to a new copper-based alloy, or rather one containing more than 90% by weight of copper, particularly adapted for the construction of components for the electronics industry thanks to its mechanical and electrical characteristics. It is known that numerous electronic components which are heavily stressed both mechanically and thermally, such as parts of switches, "lead frames" (that is the frames which support the semi-conductor plates constituting microprocessors and/or memory elements) serial bus terminal support plates, thermostat contacts and the like have to be made with alloys having, simultaneously, high ductility, high durability and mechanical strength, and high thermal and electrical conductivity; today there exist on the market very many copper-based alloys which, however, all have the inconvenience of being adapted only to a specific application for which they have been appropriately developed, and consequently each is only suitable for the construction of one or a few of the above-listed components, which is entirely unsatisfactory. Moreover, a large number of such alloys contain cadmium so that their manufacture involves heavy environmental pollution; moreover, the majority of such alloys are expensive, either because of the particularly rare elements used or, above all, because of the difficult processes for obtaining these, which require an accurate deoxidation preferably effected by means of accurate proportioning of particular deoxidising components. It is in fact known that very small percentages of oxygen drastically lower the thermal and electrical conductivity of such alloys and, above all, make soldering them impossible because of reactions which lead to hydrogen embrittlement; it is also known that, on the other hand, the addition of deoxidising elements having a high affinity for oxygen, such as phosphorus, involves the problem of accurately proportioning the content of these in dependence on the anticipated oxygen content if a drastic reduction in the conductivity by formation of solid solutions and/or phosphates is to be avoided. U.S. Pat. No. 3,677,745 resolves this latter problem in an economic manner by means of the addition of small percentages of magnesium to the alloy; this element combines with the excess phosphorus forming an intermetallic compound; this drastically limits the quantity of free P and/or Mg in the matrix and therefore avoids a drop in the conductivity even in the presence of imprecise proportions of P; moreover the intermetallic compound which forms renders the alloy subject to age-hardening by precipitation which improves its mechanical characteristics. However, the alloy the subject of the said U.S. Patent simply shifts the problem of the correct proportions from the P to the Mg, with the single advantage that the limits between which the proportion of magnesium can vary with respect to the stoichiometric proportion without detrimentally affecting the conductivity are very much wider than those of the P and can be further widened by also adding to the alloy silver (up to 0.2%) or cadmium (up to 2%). These further additions, always present in alloys produced commercially on the basis of the Patent, evidently involve the disadvantages of high cost of primary materials and the above-mentioned risk of pollution. Moreover, alloys according to U.S. Pat. No. 3,677,745 do not resolve the technical problem of making available an alloy adapted to different uses in the electronic components field; for this reason users of alloys known today must, for each type of component to be produced (lead frame, contact, etc.) arrange to store an alloy of particular chemical composition, different from that of the alloys utilised for other components. This evidently involves the impossibility of effecting economies of scale and complicates the management of production and supplies.

SUMMARY OF THE INVENTION

The object of the present invention is just that of providing a new copper-based metal alloy which has characteristics of conductivity and mechanical strength which are variable according to the requirements of the user, with the same composition, within limits sufficiently high to satisfy requirements which today are satisfied only by alloys of different composition, and at the same time present maximum values of mechanical strength and conductivity satisfactory for the electronic applications, high ductility and solderability, reduced cost, great ease of production, and which does not make use of cadmium.

This object is achieved by the invention in that it relates to a copper-based metal alloy, particularly for the construction of electronic components, characterised by the fact that it contains, in parts by weight, from 0.05 to 1% magnesium, from 0.03 to 0.9% phosphorus and from 0.002 to 0.04% calcium, the remainder being copper, including possible impurities, the ratio by weight between magnesium and phosphorus contained in the alloy lying between 1 and 5 and, in combination, the ratio by weight between magnesium and calcium contained in the alloy lying between 5 and 50.

An alloy having a composition lying within these limits in fact has, as has been found experimentally by the applicant, high values of thermal and electrical conductivity, high mechanical strength imparted by optimum combinations of resistance to breakage and yield under tension and hardness, high deformability, excellent behaviour when hot, absence of brittleness, immunity to stress corrosion and hydrogen embrittlement, good solderability and ability to be subject to heat treatments for producing segregation at the edge of the grains of finely sub-divided intermetallic compounds such that the alloy is subject to hardening by age-hardening; surprisingly, moreover, such an alloy possesses the unusual characteristic of having two different precipitation temperature intervals corresponding to which the alloy has, with absolutely identical chemical composition of the alloying elements, completely different mechanical and conductivity characteristics; with substantially the same conductivity (that is within narrow intervals of variation thereof), moreover, the alloy according to the invention, in both the different physical states following the age-hardening treatment in correspondence with one or other of the precipitation temperature intervals respectively, has the capacity of varying its mechanical characteristics over a wide range in dependence on its state of work-hardening consequent on rolling or cold drawing with different degrees of percentage reduction of the section.

BRIEF DESCRIPTION OF THE DRAWINGS

The present invention will now be described in a non-limitative manner by means of the following examples with reference to the attached drawing, in which:

FIG. 1 illustrates the behavior of the alloy according to the invention when hot; and FIG. 2 is a comparative diagram of the performance of the alloy according to the invention and that of several commercial alloys for electronic components.

DETAILED DESCRIPTION OF THE INVENTION

The alloy according to the invention is substantially a metal alloy having a copper-based matrix which is present in the alloy in percentages by weight greater than 99%, and containing a new combination of alloying elements constituted by magnesium (Mg), phosphorus (P) and calcium (Ca) in special proportions able to make them interact in such a way as to form between them and with the copper, binary, tertiary and quaternary intermetallic compounds, the possibility of the existence of these latter being brought to light for the first time by the present invention; the alloy advantageously also contains tin, in percentages by weight variable between about 0.03% and 0.15%, preferably close to the upper limit, and can moreover contain, as well as the inevitable traces of various elements, in particular iron, which constitute, however, non-dangerous impurities, small quantities of silver and/or zirconium, respectively in percentages of the order of 0.01–0.05 and 0.01–0.06% by weight, for the purpose of increasing the firing temperature, and small quantities (not greater than 0.01% by weight) of lithium and/or manganese utilised as desulphurising elements. The alloy according to the invention thus has a nominal composition by weight constituted by 0.22% Mg, 0.20% P, 0.01% Ca and 0.10% Sn, the remainder being Cu, including possible impurities; these nominal percentages of the said alloying elements can vary within relatively wide limits without altering the above-described novel characteristics of the alloy, and more particularly the magnesium can vary between 0.05 and 1% by weight, the phosphorus can vary between 0.03 and 0.90% by weight, and the calcium can vary between 0.002 and 0.040% by weight, whilst the tin can vary between the limits already explained, but preferably never less than 0.08% by weight. Although the previously described new and appreciable characteristics of the alloy according to the invention are also obtainable without the introduction of the tin, so that the invention refers essentially to a quaternary alloy Cu-Mg-P-Ca, penternary alloys Cu-Mg-P-Ca-Sn must also be considered as part of the invention it being surprisingly found that the tin not only considerably increases the hot flowability and castability of the alloy of the invention, but can also directly participate in the formation of the intermetallic compounds on which the superior characteristics thereof depend; these latter are improved by the tin, and the range of possible variation in the proportions of the alloying elements, in particular the deoxidising phosphorus and dephosphorising calcium are increased with respect to the basic quaternary alloy free of tin.

The alloy according to the invention arises from the research conducted by the Applicant starting from U.S. Pat. No. 3,677,745, from the tertiary state diagrams of Cu-Mg-Sn and Cu-Mg-Ca alloys developed on the basis of the studies of Bruzzone (Less-Common Metals, 1971, 25, 361) and of Venturello and Fornaseri (Met. Ital., 1937, 29, 213) and on the studies of W THURY (Metall, 1961, Vol. 15, Nov. PP. 1079–1081) which have demonstrated how copper can be deoxidised by additions of phosphorus without influencing the conductivity by means of the elimination of the excess phosphorus with additions of calcium, which combines with the phosphorus to give calcium phosphate which does not reduce the conductivity. On the basis of this state of the art the applicant's technicians, encouraged by the theoretical possibility for Ca and Sn of forming intermetallic compounds with Mg and Cu, sought to produce copper alloys having a high strength and conductivity and good solderability by means of the addition to copper, preliminarily deoxidised according to the method of THURY with the addition of P and Ca, of Mg and/or Sn in the hope that one or both of these alloying elements would be capable of bonding with the possible excess of calcium to form intermetallic compounds with this or with the copper of the matrix; in this way it was hoped to make the resulting alloy susceptible of hardening by age-hardening, thus obtaining an increase in the mechanical strength, and simultaneously it was hoped to resolve, without recourse to precious alloying elements such as silver, the problem of the proportioning of the deoxidising elements. Limited to this latter aspect, in fact, the deoxidising mechanism effected in U.S. Pat. No. 3,677,745 by means of P and Mg was not satisfactory in that, as already emphasised, it did not overcome the problem of monitoring the proportioning of the deoxidising agents, but simply rendered them less serious, especially in the presence of Ag in the alloy. On the other hand, the use of Ca in place of Mg as dephosphorising agent with respect to residual P after the deoxidation already on its own appeared more advantageous in relation to the conservation of a high conductivity, and in any case offered the further theoretical possibility of combining the two methods by means of the elimination of the residues with an addition of Mg, which could offer the same advantages offered in the said U.S. Patent by the addition of silver or cadmium. Experimental tests made by the applicant have, on the other hand demonstrated that not only have the expected results been obtained, but that the interaction between the alloying elements was very much more than expected and involved, before the precipitation treatment, or rather already upon solidification of the alloy after fusion, provided that certain proportions between the ingredients of the alloy was respected, the formation of entirely unexpected and completely unforeseeable intermetallic compounds such as a quaternary CuMgPCa compound which has been detected by electron microscope in transmission and which has dimensions of the order of 0.4–0.5 microns; such compounds were also accompanied by the presence of submicroscopic particles of CuP, CuPMg, PCa and CuMg detected in the metal matrix with a scanning electron microscope having an enlargement of 6–9000. Accompanying the presence of the said intermetallic compounds before age-hardening treatment it was found that there was a surprising behaviour of the alloy, which is entirely new and unexpected, that is to say this had two age-hardening temperatures, or rather temperature intervals, which were different from one another. In substance the applicant has brought to light that, in the presence of such unexpected compounds, due to the particular composition of the alloy, this became susceptible of being subject not to one, but to two different age-hardening treatments at different temperatures, following which the alloy assumed completely different final characteristics whilst having entirely the same initial composition. Such entirely new and surprising behaviour in a copper-based alloy makes it possible to effect great economies of scale, in particular in the electronic component industry; in fact, the alloy of the invention, thanks to the said characteristic, is able, on its own, to satisfy requirements which are even very different from one another simply by subjecting it to a different heat treatment, a treatment which because of its simplicity can be performed even by the final user who, therefore, can store raw elements which have not been age-hardened and, in dependence on the variable requirements, effect on these an artificial age-hardening at different temperatures and a subsequent cold, more or less forceful deformation working in such a way as to obtain a final product having the characteristics desired from time to time, something which has been obtainable until now only by using different alloys of different chemical composition which were absolutely not interchangeable as to the final use. This fundamental result of the invention is obtained not only by realising a copper alloy having the above-described content of Mg, P and Ca, but also by taking care that the ratios between these alloying elements remains within certain limits, beyond which the alloy loses its particular characteristics; in particular the ratio by weight between the magnesium and phosphorus content in the alloy must lie between 1 and 5 and, simultaneously as well as respecting this primary ratio the ratio by weight between the magnesium and calcium content in the alloy must lie between 5 and 50. The improved results are obtained with a content of calcium in the alloy lying between 0.002 and 0.02% by weight and with an Mg/P ratio by weight lying between 1 and 3 in combination with a ratio by weight of Mg/Ca lying between 10 and 20. It is supposed that these limitations correspond to the necessity of determining within the alloy particular stoichiometric ratios between the components in correspondence with which, and only with which, the first discussed quaternary intermetallic compounds are formed which, it is believed, determines whether the alloy has imparted to it the capacity of assuming different mechanical characteristics in correspondence with different age-hardening temperatures; the presence of CaP, CuMg and CuP before the precipitation is, in fact, normal, whilst the presence of CuMgP and CuCaMgP is entirely unexpected and can be considered to be due to a partial precipitation which has already taken place during the hot working. Consequently it is justified to think that during the precipitation which takes place upon age-hardening the CaP reacts with CuMg to give CuCaMgP finely dispersed at the edges of the grains. For the rest, the copper alloy according to the invention is produced in a conventional manner by means of fusion and subsequent casting, then working the solidified alloy by means of rolling or hot extrusion at a temperature lying between 860° and 890° C. and subsequent working the alloy by means of rolling or cold drawing to obtain a reduction in section lying between 50% and 80%; then artificial age-hardening of the alloy is effected by means of a precipitation heat treatment which, as opposed to the methods of production used for conventional alloys, consists in maintaining the alloy, for a sufficient time (1 or 2 hours) at a temperature lying within a selected interval either between 365°-380° C. or between 415°-425° C. depending on whether it is desired to obtain improved mechanical or electrical characteristics respectively.

EXAMPLE I

In a gas crucible furnace having a crucible of the silicon carbide type, of a capacity of about 100 Kg experimental melts were made with loads of 70 Kg of 99.9 ETP copper melted under a covering flux of borax with successive casting in water cooled ingot moulds having a diameter of 220 mm; subsequently they are deoxidised by the addition of 1.1 Kg of copper phosphate (85% by weight Cu and 15% by weight P) positioned by means of a tool onto the bottom of the crucible, and then there are added two hg of Mg and 7 gr of Ca. Having taken samples for analysis casting into ingot moulds proceeds and subsequently hot rolling (indicated for brevity as HR) of the ingots down to a thickness of 11 mm operating at a temperature lying between 860° and 890° C.; after milling or "scalping" of the thus-obtained ingots to remove the oxidised layer these are subjected to different working cycles comprising a cold rolling (indicated for brevity as CR) effected in such a way as to cause a reduction in section lying between 50% and 80% and a possible artificial age-hardening heat treatment consisting in holding it for a determined time at a temperature lying between 365° and 425° C. The thus-obtained ingots were finally subjected to hardness tests (Vickers method 100 gr./30") and standard conductivity tests according to the IACS (International Annealed Copper Standard) rules expressing the conductivity as a percentage of that of the IACS test strip at 20° C., which, as is known, presents a resistivity of 1.7241 microhms-cm. The results obtained are plotted in table I and demonstrate the capacity of the alloy, with the same chemical composition, to assume different physical and mechanical characteristics according to the type of treatment. The capacity of the alloy to resist softening when hot has also been investigated; the results obtained (Vickers micro hardness after 1 hour at the various temperatures) are plotted in FIG. 1.

TABLE 1

| Working | Electrical Conductivity % IACS | Hardness HV |
|---|---|---|
| HR | 60 | 70–90 |
| HR + CR 67% | 56 | 130–150 |
| HR + CR 67% + 365° C. × 1 h | 68 | 155 |
| HR + CR 67% + 380° C. × 1 h | 71 | 155 |
| HR + CR 67% + 400° C. × 1 h | 78 | 96.5 |
| HR + CR 67% + 415° C. × 1 h | 81 | 88 |
| HR + CR 67% + 425° C. × 1 h | 81 | 87.6 |
| HR + CR 67% + 435° C. × 1 h | 81 | 86.7 |
| HR + CR 67% + 450° C. × 1 h | 81 | 84.6 |
| HR + CR 85% | 52 | 160–170 |
| HR + CR 85% + 415° C. + 2 h | 80 | 92 |
| HR + CR 85% + 425° C. + 2 h | 82 | 90 |

EXAMPLE II

Operating as in Example I, but in an industrial induction furnace having a capacity of 4 tonnes and associated with a semi-continuous casting position and proportionately adapting the quantities of copper and alloying elements to the different capacity of the furnace, ingots are obtained which are hot rolled at a temperature of 870° C. down to a thickness of 11 mm throughout; then the rolled ingots thus obtained are further cold rolled with a reduction in section of 50%, obtaining a rolled ingot of 5.5 mm in thickness; this, after having taken samples, is separated into two parts respectively indicated A and B and subsequently treated in an electric furnace with a heat cycle involving two hours of heating, two hours of remaining at the temperature and five hours of cooling; the part A is treated at 425° C. whilst part B is treated at 370° C. Each part, after the heat treatment, is further subdivided into sub groups indicated with the numerals 1, 2 and 3; the sub groups 1 are cold rolled with a reduction in section of 20% in such a way as to produce a mild work-hardening; the sub groups 2 are rolled to a 45% reduction in section in such a way as to obtain a greater work-hardening (semi-hard state), whilst sub groups 3 are rolled to a 98% reduction in such a way as to make the rolled ingot strongly work-hardened (hard state). Samples of parts A and B are taken before the further rolling and from each sub group 1, 2 and 3 after rolling, and subjected to the normal tests of mechanical strength and conductivity. The results obtained are plotted in Tables II and III.

TABLE II

| Characteristics of the alloy after age-hardening | Type A | Type B |
|---|---|---|
| Electrical Conductivity (*) | 80% IACS | 70% IACS |
| Thermal Conductivity (Kcal/hm° C.) | 274.7 | 240.3 |
| Density (kg/dm$^3$) | 8.796 | 8.796 |

(*)Expressed as a percentage of the conductivity of the International Annealed Copper Standard test strip at 20° C.

TABLE III

| Characteristics of the alloy in different physical states | | | | | | |
|---|---|---|---|---|---|---|
| Test Strip Type | Resistance to tension N/mmq | Yield strength N/mmq | A% | HV | Number of alternate folds | Electrical Conductivity % IACS |
| A 1 | 350 | 260 | 21 | 100 | 20 | 80 |
| A 2 | 460 | 420 | 8 | 140 | 15 | 78 |
| A 3 | 550 | 510 | 2 | 160 | 10 | 76 |
| B 1 | 472 | 428 | 15 | 150 | 26 | 70 |
| B 2 | 550 | 480 | 4 | 170 | 15 | 68 |
| B 3 | 710 | 650 | 13 | 190 | 6 | 63 |

EXAMPLE III

Operating as in Example II there are produced three tons of an alloy having the following percentage composition by weight:

0.25% Mg 0.20% P 0.01% Ca 0.10% Sn Remainder Cu

The alloy produced is subdivided into two parts indicated "Type A" and "Type B" and subjected to different rolling and age-hardening cycles operating as in Example II; the resulting rolled ingots were then tested as in Example II and the results obtained plotted in graphical form and compared with the performances, again expressed in graphical form, of some of the principle copper alloys for electronic use at present on the market; the graphic result is plotted in FIG. 2; from this it can be appreciated that the alloy of the invention with absolutely the same chemical composition, can assume different physical characteristics according to the type of working to which it is subjected ("Type A" and "Type B" parts) as to find itself occupying positions only covered by known alloys having a completely different chemical composition (and not a different treatment). In particular, the alloy of the invention worked according to the cycle indicated in Example II for "Type A" and indicated with the reference LMI 108 A is close in performance to that of the alloy Wieland K72 (0.3 Cr-0.15 Ti-0.02 Si-Cu), whilst the same alloy, worked according to the cycle indicated in Example II for "Type B" and indicated with the reference LMI 108 B has a performance close to that of the alloy Olin C197 (0.6 Fe-0.05 Mg-0.20 P-possible 0.23 Sn-Cu).

EXAMPLE IV

Operating exactly as in Example I there are prepared alloys of different chemical composition to test the influence of the content of the various alloying elements; the samples produced and subjected first to a hot extrusion at 870° C. in such a way as to bring it down to a diameter of 24.5 mm and then cold drawing to bring it down to a diameter of 14.5 mm are then age-hardened at different temperatures and then tested with a standard conductivity test and with a Vickers hardness test; the results obtained are indicated in Table IV.

TABLE IV

| Influence of the alloying elements | | | | | | | |
|---|---|---|---|---|---|---|---|
| Alloying Elements (% by weight) (Remaining Cu 99.9 ETP) | | | | | Heat | Conduct- | |
| Mg | P | Ca | Sn | Ag | Treatment | ivity | HV |
| 0.22 | 0.20 | 0.0056 | 0.15 | 0.03 | 365° C. × 1 h | 67 | 155 |
| 0.22 | 0.20 | 0.0056 | 0.15 | — | 365° C. × 1 h | 66 | 155 |
| 0.22 | 0.20 | 0.0070 | 0.08 | — | 365° C. × 1 h | 69 | 155 |
| — | 0.20 | 0.02 | — | — | 365° C. × 1 h | 88 | 50 |
| 0.20 | 0.20 | 0.02 | — | — | 365° C. × 1 h | 68 | 154 |
| 0.20 | 0.20 | 0.02 | — | — | 380° C. × 1 h | 71 | 154 |
| 0.20 | 0.20 | 0.02 | — | — | 415° C. × 1 h | 81 | 87.5 |
| 0.20 | 0.20 | 0.02 | 0.10 | — | 415° C. × 2 h | 82 | 88 |
| 0.29 | 0.22 | 0.0258 | 0.10 | — | 415° C. × 2 h | 81 | 88 |
| 0.22 | 0.25 | 0.025 | 0.10 | — | 380° C. × 1 h | 74 | 155 |
| 0.22 | 0.25 | 0.025 | 0.10 | — | 415° C. × 1 h | 75 | 152 |
| 0.22 | 0.18 | 0.05 | 0.10 | — | 380° C. × 1 h | 71 | 151 |
| 0.22 | 0.18 | 0.05 | 0.10 | — | 415° C. × 1 h | 71 | 149 |
| 1 | 0.90 | 0.04 | 0.15 | — | 380° C. × 1 h | 72 | 155 |
| 1. | 0.90 | 0.04 | 0.15 | — | 415° C. × 1 h | 81 | 90 |

I claim:

1. A copper based metal alloy, particularly for the construction of electronic components, which comprised, in parts by weight, from 0.05 to 1% magnesium, from 0.03 to 0.9% phosphorus and from 0.002 to 0.04% calcium, the remainder being copper, the ratio by weight between magnesium and phosphorus contained in the alloy lying between 1 and 5 and, in combination, the ratio by weight between magnesium and calcium contained in the alloy lying between 5 and 50.

2. A metal alloy according to claim 1, wherein the content by weight of calcium lies between 0.002% and 0.02%, the ratio by weight between magnesium and phosphorus lying between 1 and 3 and, in combination, the ratio by weight between magnesium and calcium lying between 10 and 20.

3. A metal alloy according to claim 1, further containing a quantity of tin comprising, by weight, between 0.03% and 0.15%, the remainder being copper.

4. A conductive element comprising an alloy according to claim 1.

5. A metal alloy according to claim 3, further containing from 0.01 to 0.05% by weight of zirconium, the remainder being copper.

6. A metal alloy according to claim 3, further containing from 0.02 to 0.06% by weight of silver, the remainder being copper.

7. A metal alloy according to claim 3, further containing up to 0.01% by weight of lithium, the remainder being copper.

8. A metal alloy according to claim 3, further containing up to 0.01% by weight of manganese, the remainder being copper.

* * * * *